US006267847B1

(12) United States Patent
Doelle et al.

(10) Patent No.: US 6,267,847 B1
(45) Date of Patent: Jul. 31, 2001

(54) PULPER FOR A STOCK PREPARATION SYSTEM

(75) Inventors: Klaus Doelle; Robert J. Matz, both of Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/440,225

(22) Filed: Nov. 15, 1999

(51) Int. Cl.[7] ..... D21C 7/06

(52) U.S. Cl. ..... 162/246; 162/241; 162/28; 162/52; 366/303; 366/307; 366/186; 366/15; 366/27; 366/76; 366/4; 222/368

(58) Field of Search ..... 162/246, 241, 162/28, 52; 366/303, 307, 186, 15, 27, 76, 4; 222/368

(56) References Cited

U.S. PATENT DOCUMENTS 3,773,610 * 11/1973 Shouvlin ..... 162/19
4,121,967 * 10/1978 Reinhall ..... 162/246
5,198,075 * 3/1993 De La Bruniere ..... 162/19

* cited by examiner

*Primary Examiner*—Peter Chin
*Assistant Examiner*—Mark Halpern
(74) *Attorney, Agent, or Firm*—Taylor & Aust, P.C.

(57) ABSTRACT

A pulper in a stock preparation system includes a housing with a fiber inlet, at least one water inlet, at least one outlet and an inner chamber. A plurality of stationary pulping foils are attached to the housing and extend into the inner chamber. A rotatable shaft assembly extends through the inner chamber. The shaft assembly includes a shaft, an auger positioned around the shaft and relative to the fiber inlet and a plurality of movable pulping foils carried by and extending from the shaft. A conical valve is positioned in association with the outlet and is selectively movable to open and close the outlet.

37 Claims, 6 Drawing Sheets

PULPER FOR A STOCK PREPARATION SYSTEM

BACKGROUND OF THE INVENTION

1. Field of the Invention

The present invention relates to a stock preparation system for preparing a fiber suspension for use in a papermaking machine, and, more particularly, to a pulper in such a stock preparation system.

2. Description of the Related Art

A fiber stock preparation system is used to make a fiber suspension from a source of fiber such as wood. The fiber stock preparation system receives the raw source of fiber, breaks the raw source of fiber into individual fibers suspended within a liquid such as water, and separates contaminants from the fiber suspension.

It is known to provide a pulper in a fiber stock preparation system as described above to break down the raw source of fiber into individual fibers. A pulper typically includes a rotatable element therein which imparts mechanical forces to the source of fiber and breaks the source of fiber into individual fibers. The pulped fiber is transported downstream to other mechanical devices within the stock preparation system. For example, the pulped fiber may be further processed within a disperger. A disperger receives the pulped fiber and removes contaminants from the fiber suspension and thoroughly mix chemicals within the fiber suspension. The disperger includes a shaft assembly with a plurality of foils which move in very close proximity relative to a plurality of foils carried by a housing. The tight tolerances within the disperger are intended to process the liquid under relatively high pressure so that the chemicals may be thoroughly mixed and the contaminants removed. To achieve thorough mixing of the chemicals, the dwell time of the fiber suspension within the disperger is relatively long. The disperger has an output which is in the form of an open end of the housing which discharges directly to the ambient environment. Because of the tight tolerances and pressures utilized within the disperger, a high energy input is required to drive a disperger. Moreover, such a disperger has a low throughput rate.

What is needed in the art is a pulper which has a high throughput rate, may be oriented in multiple orientations and requires very little input energy for pulping of the input source of fiber.

SUMMARY OF THE INVENTION

The present invention provides a pulper in a stock preparation system with a drum and a plurality of stationary pulping foils, a shaft assembly having an auger and a plurality of movable pulping foils, and a conical valve positioned with respect to an outlet of the drum and movable in directions toward and away from the outlet to selectively open and close the outlet.

The invention comprises, in one form thereof, a pulper in a stock preparation system. The pulper includes a housing with a fiber inlet, at least one water inlet, at least one outlet and an inner chamber. A plurality of stationary pulping foils are attached to the housing and extend into the inner chamber. A rotatable shaft assembly extends through the inner chamber. The shaft assembly includes a shaft, an auger positioned around the shaft and relative to the fiber inlet and a plurality of movable pulping foils carried by and extending from the shaft. A conical valve is positioned in association with the outlet and is selectively movable to open and close the outlet.

An advantage of the present invention is that a pulper with a simplified construction and high throughput rate is provided.

Another advantage is that the conical valve at the discharge outlet of the drum provides easy regulation of the throughput rate through the pulper.

Yet another advantage is that one or more shaft assemblies with multiple augers and movable pulping foils may be provided in association with a single inlet to increase the throughput rate through the pulper.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
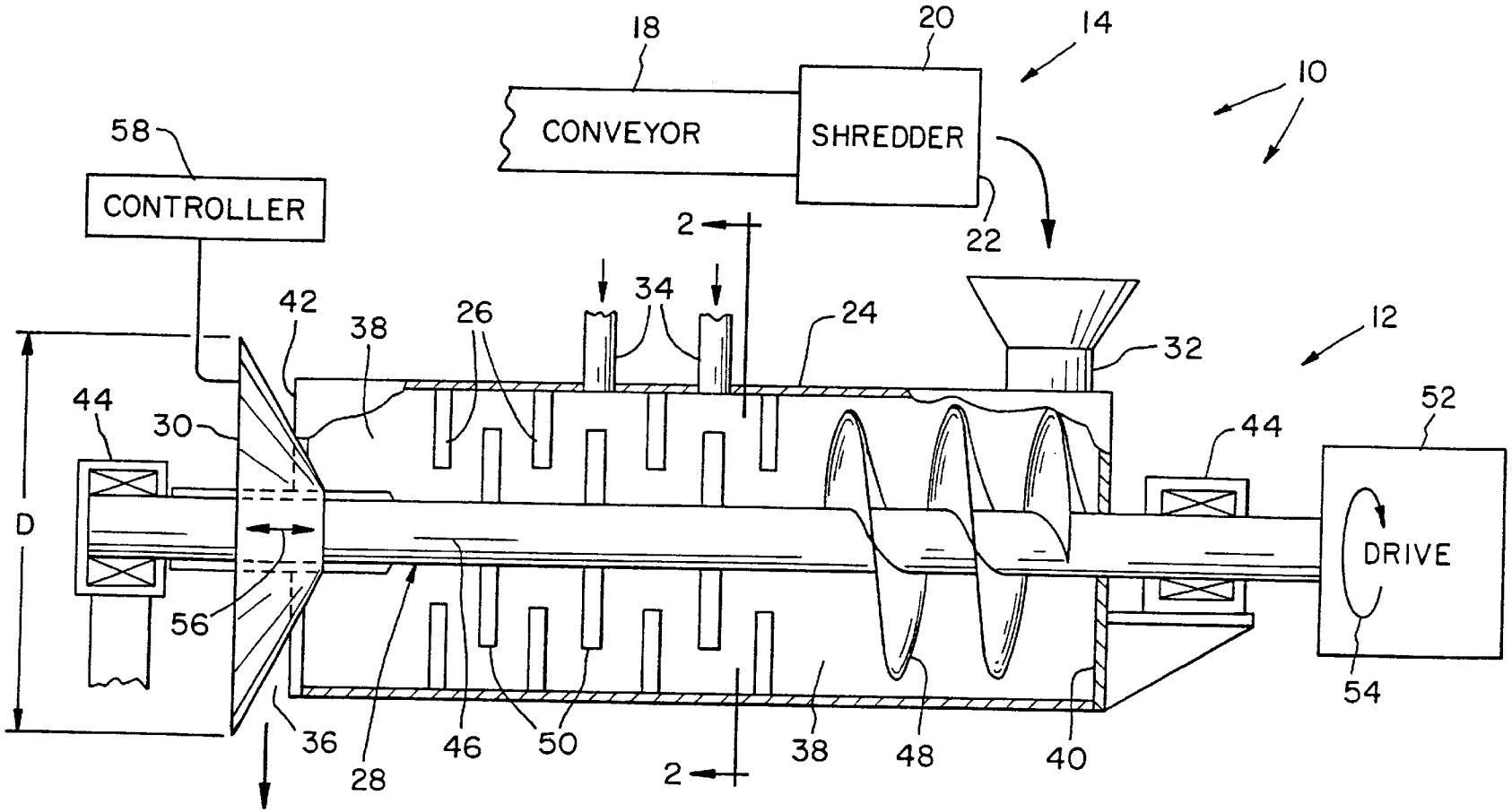
FIG. 1 is a schematic, side view of a stock preparation system including an embodiment of a pulper of a present invention.
Figure 2:
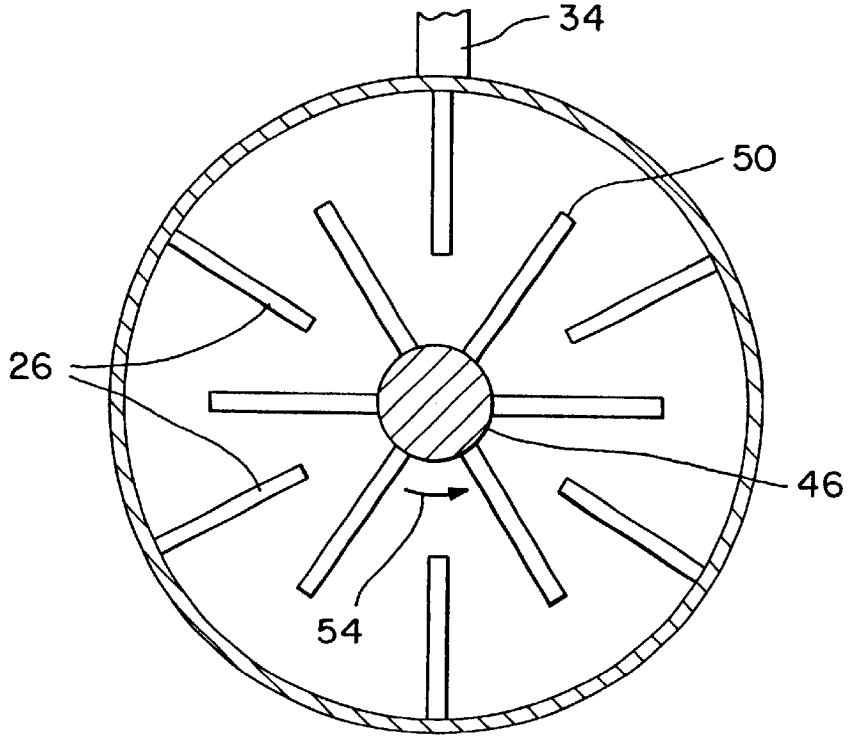
FIG. 2 is a sectional view taken along line 2—2 in FIG. 1.

Referring now to the drawings, and more particularly to FIG. 1, there is shown a stock preparation system 10 including an embodiment of a pulper 12 of the present invention, feed device 14 and screen 16.

Feed device 14 provides and input source of fiber such as wood fiber or recycled paper to pulper 12. In the embodiment shown, feed device 14 includes a conveyor 18 and a shredder 20. Conveyor 18 receives the input source of fiber such as a bale of recycled paper or cardboard and provides the input source of fiber to shredder 20. Shredder 20 is configured to shred the input source of fiber into smaller pieces which are useable by pulper 12. Shredder 20 has an outlet 22 from which the shredded input source of fiber is discharged.

Although feed device 14 is shown in the form of a conveyor 18 and shredder 20 in the embodiment of FIG. 1, it is also possible for feed device 14 to be configured differently as part of stock preparation system 10 for providing an input source of fiber to pulper 12. For example, feed device 14 may be in the form of a sedimentation tank (not shown) with an outlet from which a shredded input source of fiber is discharged to pulper 12.

Screen 16 receives the pulped input source of fiber from pulper 12 and further processes the pulped input source of fiber into a fiber suspension which is utilized by a paper-making machine. In the embodiment shown, screen 16 is in the form of a screen drum used to separate foreign particles from the pulped input source of fiber. Screen 16 may also be configured as a vibration screen or other type of screen for further processing the pulped input source of fiber. Moreover, although pulper 12 is shown as discharging the pulped input source of fiber to a screen 16, it is also possible to discharge the pulped input source of fiber to another type of device within stock preparation system 10 for further processing of the pulped input source of fiber into a fiber suspension useable by a paper-making machine.

Pulper 12 generally includes a housing or drum 24, plurality of stationary pulping foils 26, rotatable shaft assembly 28 and valve 30. Housing 24 includes a fiber inlet 32, a pair of water inlets 34, an outlet 36 and an inner chamber 38. In the embodiment shown, housing 24 is in the form of a cylindrical drum with a closed end 40 adjacent fiber inlet 32 and surrounding shaft assembly 28, and an open end 42 defining outlet 36. Stationary pulping foils 26 are spaced apart at predetermined intervals along a length of housing 24. Stationary pulping foils 26 are attached to and extend radially inward from housing 24 a predetermined distance relative to shaft assembly 28. Stationary pulping foils 26 may either be separate from and attached to housing 24, or may be integrally formed with housing 24. In the embodiment shown, four concentric rows of pulping foils 26 are provided along the length of housing 24, with each concentric row including a plurality of stationary pulping foils 26 which are angularly spaced around the inside diameter of housing 24 within inner chamber 38. Each adjacent pair of concentric rows of stationary pulping foils 26 defines an annular space therebetween which coacts with shaft assembly 28 to pulp the input source of fiber, as will be described in more detail hereinafter.

Drum 24 has an inside diameter defining inner chamber 38 which is between two to three meters. In the embodiment shown, drum 24 is oriented in a generally horizontal position. However, it is to be understood that drum 24 may also be oriented at a vertical position with valve 30 positioned under drum 24, or at a selected angle between 0 and 90°, preferably between 0 and 45°, relative to the horizontal position shown in FIG. 1.

Shaft assembly 28 extends through inner chamber 38 and is rotatably carried at each end thereof by reduced friction bearing supports 44. Shaft assembly 28 includes a shaft 46, auger 48 and a plurality of movable pulping foils 50. Shaft 46 is a cylindrical shaft which is directly carried by bearing supports 44 at each end of shaft assembly 28. Each bearing support 44 is in turn carried by a suitable support structure or framework within stock preparation system 10. Shaft 46 is coupled with and driven by a rotatable drive 52, as indicated by arrow 54.

Auger 48 is attached with and surrounds shaft 46. Auger 48 is positioned relative to fiber inlet 32 to receive the input source of fiber from feed device 14. Auger 48 has a pitch and angular orientation, depending upon the direction of rotation and rotational speed of shaft 46, which is selected to move the input source of fiber from fiber inlet 32 to outlet 36. Auger 48 preferably has an outside diameter which extends closely adjacent to the inside diameter of housing 24 such that auger 48 is free to rotate within housing 24 while substantially inhibiting reverse flow of the input source of fiber within housing 24.

Movable pulping foils 50 are carried by and extend from shaft 46. In the embodiment shown, shaft assembly 28 includes three conical rows of movable pulping foils 50 which are spaced along the length of shaft 46. Each conical row of movable pulping foils 50 includes a plurality of movable pulping foils which are angularly spaced around the periphery of shaft 46. Each conical row of movable pulping foils 50 is positioned within a corresponding annular space between a pair of conical rows of stationary pulping foils 26. Pulping foils 50 move with respect to stationary pulping foils 26, and thus are defined as "movable" pulping foils 50 herein.

Figure 3:
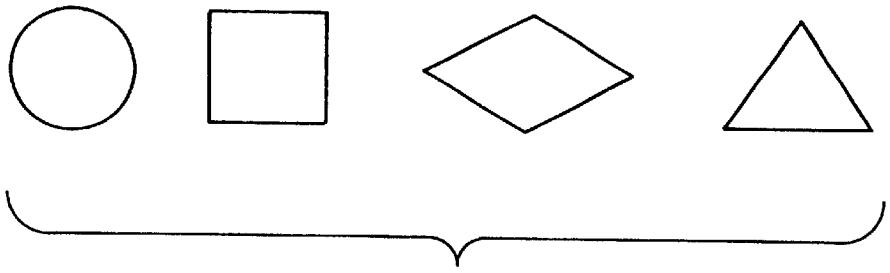
FIG. 3 is an end view of different possible cross-sectional shapes of the foils shown in FIGS. 1 and 2.

Stationary pulping foils 26 and movable pulping foils 50 each have a cross-section which is selected to provide optimum pulping of the input source of fiber received within pulper 12. For example, each of stationary pulping foils 26 and/or movable pulping foils 50 may be configured with a cross-section which is circular, square, diamond or triangular shaped, as shown in FIG. 3. Pulper 12 may be configured such at each of stationary pulping foils 26 and movable pulping foils 50 have a common cross-sectional shape, or may be configured with different cross-sectional shapes, depending upon the specific application.

Valve 30 is positioned in association with outlet 36, and is selectively movable toward and away from open end 42 of housing 24, as indicated by double headed arrow 56. In the embodiment shown, valve 30 is configured as a conical valve. A controller 58 moves conical valve 30 to a selected position, depending upon user input, a preselected position, or sensed physical characteristics associated with the pulped fiber suspension discharged from outlet 36. Thus, outlet 36 is a variable annular space between conical valve 30 and open end 42. When conical valve 30 is moved to a full open position adjacent bearing support 44 as shown in FIG. 1, annular shaped outlet 36 is at a maximum position and allows maximum throughput through pulper 12. When conical valve 30 is positioned at or closely adjacent to open end 42, outlet 36 is at the minimum position allowing substantially no throughput through pulper 12. Conical valve 30 may also be selectively positioned at any position therebetween allowing a selected throughput through pulper 12. By providing conical valve 30 with a diameter D which is larger than the inside diameter of housing 24, conical valve 30 effectively closes open end 42 and thereby closes outlet 36.

In contrast with a conventional disperger used in a stock preparation system, pulper 12 of the present invention provides a very high throughput rate with minimal input energy. A disperger includes a shaft assembly with an auger and movable pulping foils which move relative to stationary pulping foils within a housing. However, the purpose of a disperger is entirely different than that of a pulper and accordingly the configuration of the various components within a disperger is entirely different than pulper 12 of the present invention. For example, a disperger is typically utilized to remove small contaminants (such as dirt specs, stickies and coating particles) from the fiber suspension or to thoroughly mix chemicals added to the fiber suspension. Because of this functionality, the various tolerances between the moving parts within a disperger are kept at a very small distance, the throughput rate is very low and the required input energy is very high. More particularly, with a disperger of conventional design, the required input energy is between 30 and 120 kilowatt*hour/metric ton (kWh/t). The disperger receives an inlet fiber stock at a consistency of between 25 to 35% and has a throughput rate of between 30 and 700 metric tons/24 hours. The throughput rate is thus relatively very low when compared with the required input energy.

In contrast, pulper 12 of the present invention has a required input energy using rotatable drive 52 of between 0.5 and 5 kWh/t, and more particularly has an input energy of between 0.5 and 1 kWh/t. Pulper 12 receives an input source of fiber at a consistency of between 80 and 100% and provides a pulped output source of fiber at a consistency of between 15 and 50%. That is, pulper 12 receives an input source of fiber with little or no water added thereto at fiber inlet 32. Auger 48, stationary pulping foils 26 and movable pulping foils 50 are structured and arranged relative to each other to receive the dry input source of fiber and still adequately pulp the fiber for use by a paper-making machine. A disperger of conventional design cannot be utilized to pulp an essentially dry input source of fiber.

Additionally, pulper 12 has a throughput rate of between 30 and 1500 metric tons/24 hours, and preferably has a throughput rate of between 700 and 1500 metric/tons 24 hours. Pulper 12 thus has a very high throughput rate with only a very small amount of required input energy.

Figure 4:
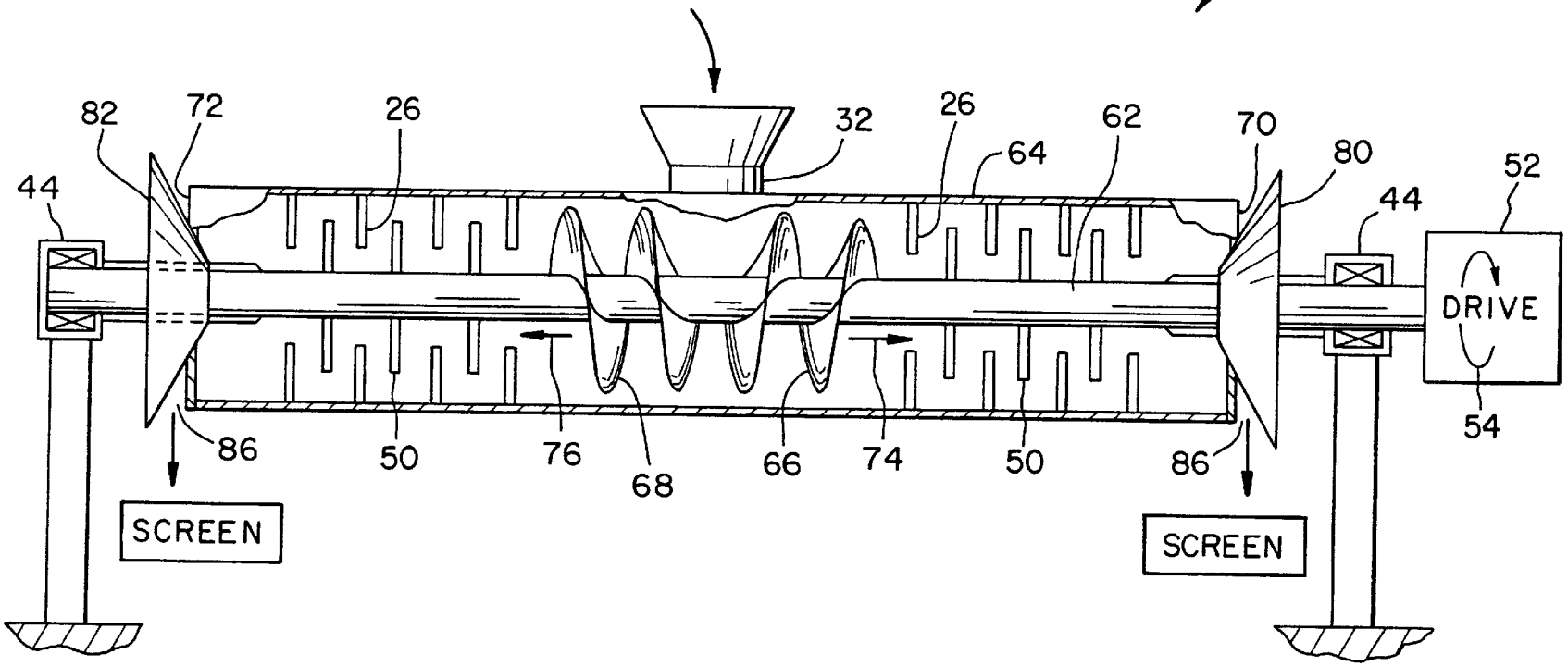
FIG. 4 is a schematic, side view of another embodiment of a pulper of the present invention.

FIG. 4 illustrates another embodiment of a pulper 60 of the present invention utilized in a stock preparation system. Pulper 60 is similar to the embodiment of pulper 12 shown in FIG. 1, and essentially is the equivalent of two pulpers 12 arranged in an end to end manner about a common shaft 62 and within a common housing 64. Shaft 62 is rotated in a single direction utilizing rotatable drive 52. Shaft 52 is coupled with and carries two augers 66 and 68, with each auger having a reverse pitch relative to the other such that the input source of fiber received at single fiber inlet 32 is fed in opposite directions toward respective open ends 70 and 72, as indicated by directional arrow 74 and 76. A pair of conical valves 80 and 82 are respectively positioned adjacent to an open end 70 and 72, and are movable toward and away from respective open end 70 and 72 to open and close discharge outlets 84 and 86. Conical valves 80 and 82 may be simultaneously or independently moved, such as by utilizing a controller 58, to selectively open and close discharge outlets 84 and 86.

Figure 5:
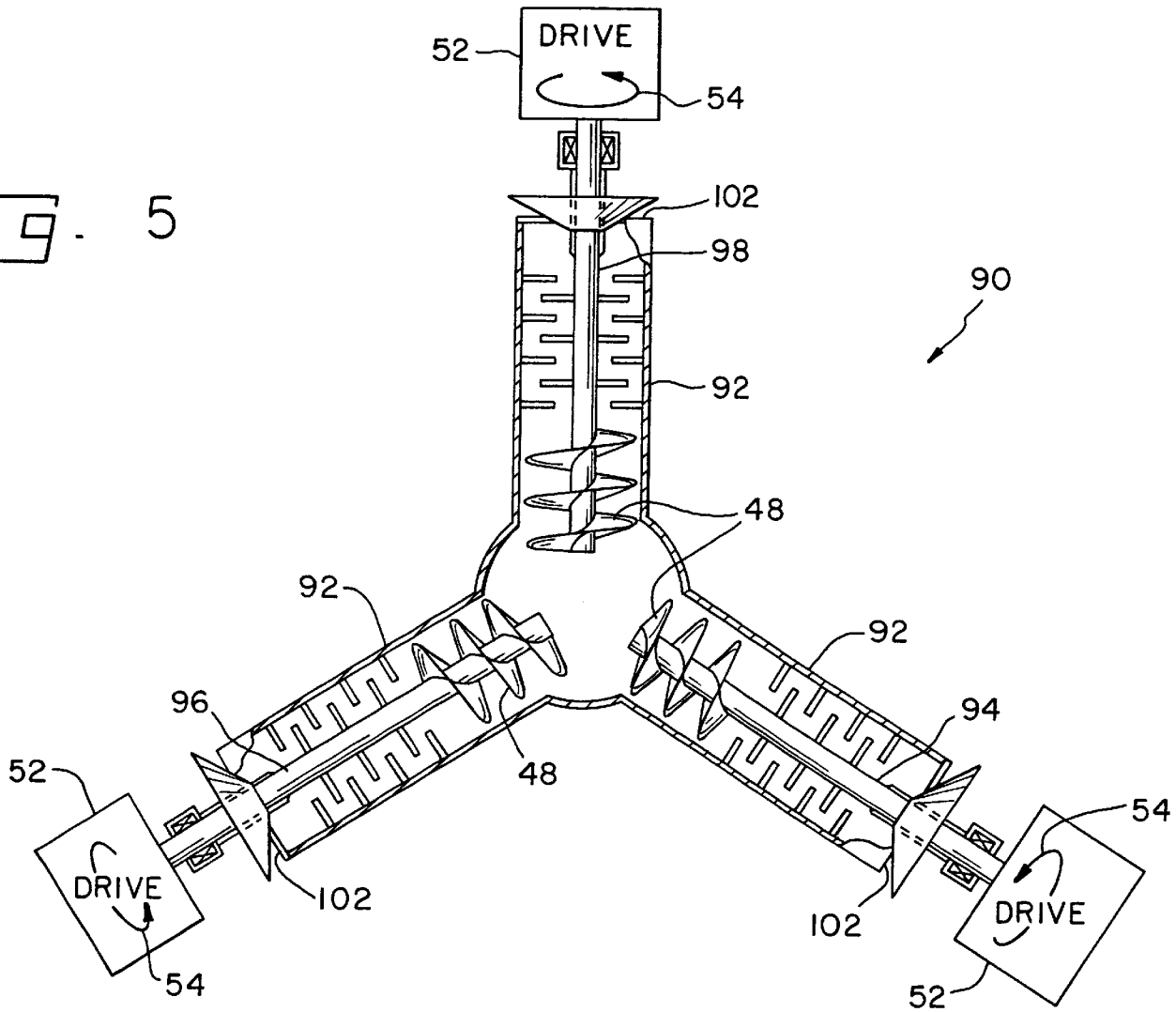
FIG. 5 is a schematic, side view of yet another embodiment of a pulper of the present invention.

FIG. 5 illustrates yet another embodiment of a pulper 90 of the present invention which includes a three part housing 92 and three independently rotatable shaft assemblies 94, 96 and 98 which are respectively positioned within the three parts of housing 92 and independently driven by rotatable drives 52. A conical valve 100 is positioned adjacent to and in association with open end 102 of each housing part of housing 92 and is selectively movable toward and away from open end 102, such as by utilizing a controller 58. Valves 100 may be commonly or independently moved relative to each respective open end 102.

Figure 6:
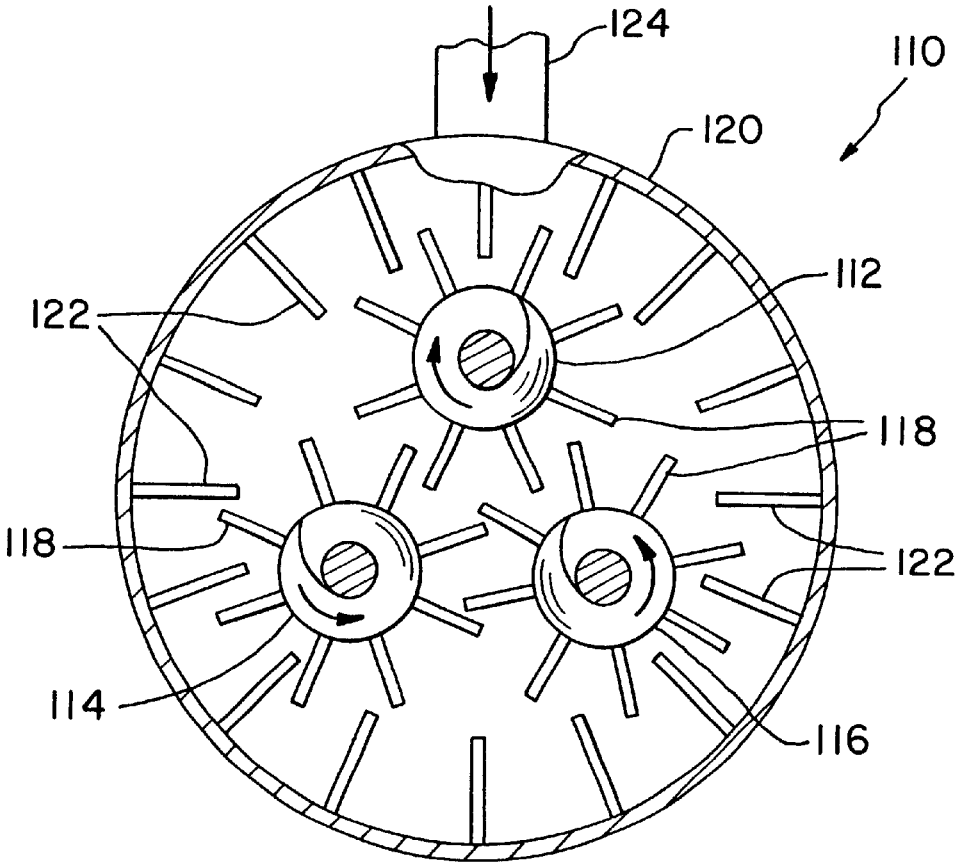
FIG. 6 is a schematic, end view of another embodiment of a pulper of the present invention.
Figure 7:
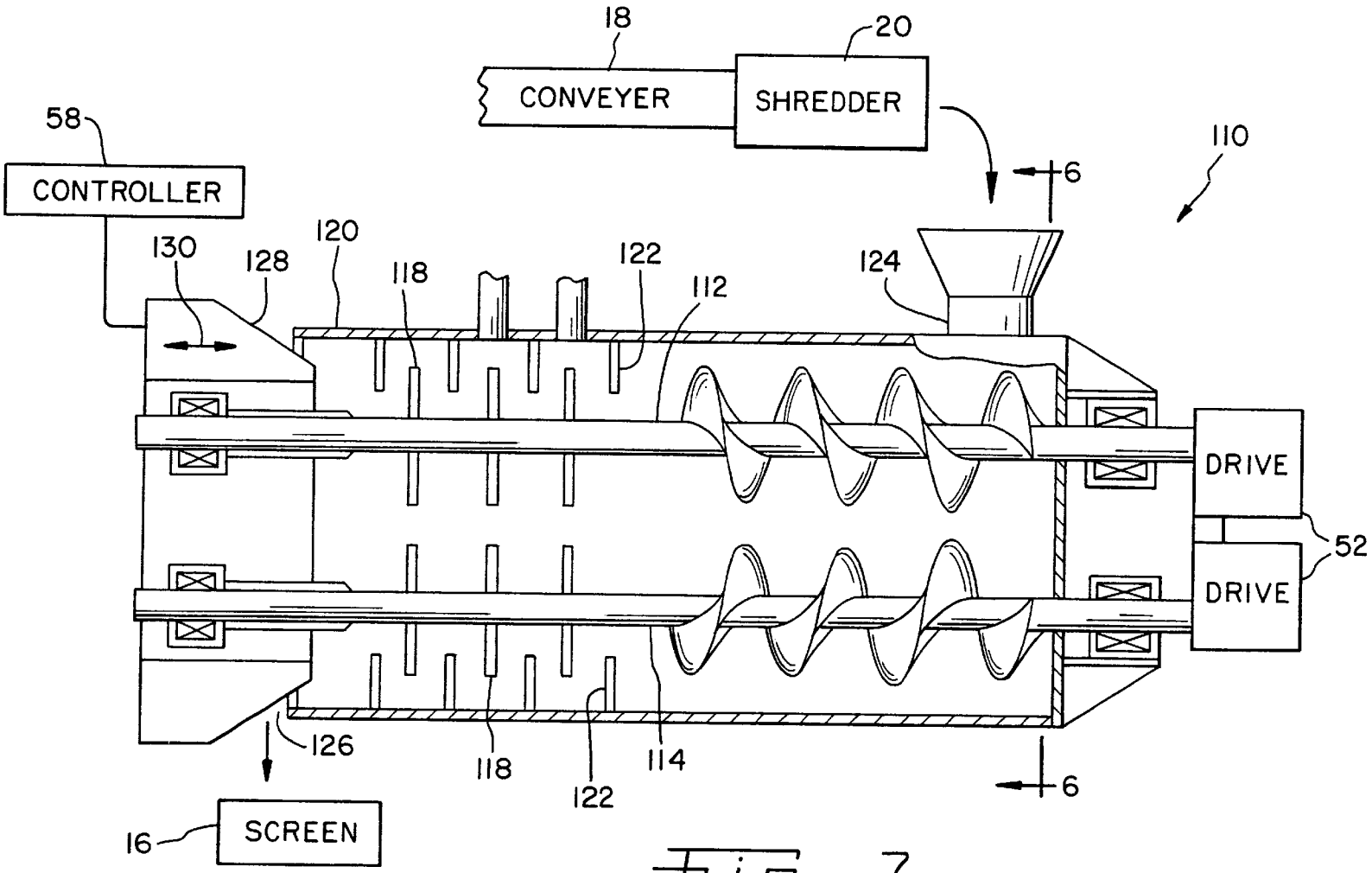
FIG. 7 is a schematic, side view of the pulper of FIG. 6.

FIGS. 6 and 7 illustrate another embodiment of a pulper 110 of the present invention. Pulper 110 includes three separate shaft assemblies 112, 114 and 116 which each include a plurality of movable pulping foils 118. Shaft assemblies 112, 114 and 116 are each disposed within a common housing 120 having a plurality of stationary pulping foils 122. Shaft assemblies 112, 114 and 116 may be dependently or independently driven in common or different rotational directions. In the embodiment shown in FIGS. 6 and 7, shaft assembly 112 is driven in a clockwise direction, while shaft assemblies 114 and 116 are driven in a counterclockwise direction. Shaft assemblies 112, 114 and 116 each receive a source of fiber at inlet 124 and discharge the pulped fiber through a common outlet 126. Valve 128 is movable in axial directions relative to shaft assemblies 112, 114 and 116, as indicated by arrow 130, to open and close outlet 126.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A stock preparation system, comprising:

a pulper including:

a housing with a fiber inlet, at least one water inlet, at least one outlet and an inner chamber;

a plurality of stationary pulping foils attached to said housing and extending into said inner chamber;

a rotatable shaft assembly extending through said inner chamber, said shaft assembly including a shaft, an auger positioned around said shaft and relative to said fiber inlet, and a plurality of movable pulping foils carried by and extending from said shaft; and a valve positioned in association with said outlet and selectively movable to open and close said outlet, said valve being a conical shaped valve positioned around said shaft and selectively movable in directions along said shaft.

2. The stock preparation system of claim 1, wherein said pulper has an input energy of between 0.5 and 5 kilowatt*hour/metric ton.

3. The stock preparation system of claim 1, wherein said pulper has an input energy of between 0.5 and 1 kilowatt*hour/metric ton.

4. The stock preparation system of claim 1, wherein said pulper has a throughput of between 30 and 1500 metric tons/24 hours.

5. The stock preparation system of claim 4, wherein said pulper has a throughput of between 700 and 1500 metric tons/24 hours.

6. The stock preparation system of claim 1, wherein said pulper is configured to receive an input source of fiber at a consistency of between 80 and 100% and provides a pulped output source of fiber at a consistency of between 15 and 50%.

7. The stock preparation system of claim 1, wherein said outlet has an outlet diameter and said valve has a diameter which is at least as large as said outlet diameter.

8. The stock preparation system of claim 1, wherein each of said stationary pulping foils and said movable pulping foils have a cross-section which is one of circular, square, diamond and triangular shaped.

9. The stock preparation system of claim 1, further comprising a rotatable drive connected with said shaft.

10. The stock preparation system of claim 1, wherein said housing comprises a drum.

11. The stock preparation system of claim 10, wherein said drum has an inside diameter defining said inner chamber of between 2 and 3 meters.

12. The stock preparation system of claim 10, wherein said drum has a longitudinal axis which is oriented one of horizontal, vertical and at an angle of between 0 and 45° relative to the horizontal.

13. The stock preparation system of claim 1, wherein said at least one water inlet comprises two water inlets.

14. The stock preparation system of claim 1, wherein said at least one outlet comprises one outlet.

15. The stock preparation system of claim 1, further comprising a feed device having an outlet positioned in association with said fiber inlet, said feed device comprising one of a conveyor and a sedimentation tank.

16. The stock preparation system of claim 15, wherein said feed device includes a shredder.

17. The stock preparation system of claim 1, further comprising a screen positioned relative to and downstream from each said outlet.

18. The stock preparation system of claim 17, wherein said screen comprises one of a vibration screen and screen drum.

19. A pulper in a stock preparation system, comprising:

a housing with a fiber inlet, at least one water inlet, at least one outlet and an inner chamber;

a plurality of stationary pulping foils attached to said housing and extending into said inner chamber;

a rotatable shaft assembly extending through said inner chamber, said shaft assembly including a shaft, an auger positioned around said shaft and relative to said fiber inlet, and a plurality of movable pulping foils carried by and extending from said shaft; and a valve positioned in association with said outlet and selectively movable to open and close said outlet, said valve being a conical shaped valve positioned around said shaft and selectively movable in directions along said shaft.

20. The pulper of claim 19, wherein said pulper has an input energy of between 0.5 and 5 kilowatt*hour/metric ton.

21. The pulper of claim 19, wherein said pulper has an input energy of between 0.5 and 1 kilowatt*hour/metric ton.

22. The pulper of claim 19, wherein said pulper has a throughput of between 30 and 1500 metric tons/24 hours.

23. The pulper of claim 22, wherein said pulper has a throughput of between 700 and 1500 metric tons/24 hours.

24. The pulper of claim 19, wherein said pulper is configured to receive an input source of fiber at a consistency of between 80 and 100% and provides a pulped output source of fiber at a consistency of between 15 and 50%.

25. The pulper of claim 19, wherein said outlet has an outlet diameter and said valve has a diameter which is at least as large as said outlet diameter.

26. The pulper of claim 19, wherein each of said stationary pulping foils and said movable pulping foils have a cross-section which is one of circular, square, diamond and triangular shaped.

27. The pulper of claim 19, further comprising a rotatable drive connected with said shaft.

28. The pulper of claim 19, wherein said housing comprises a drum.

29. The pulper of claim 28, wherein said drum has an inside diameter defining said inner chamber of between 2 and 3 meters.

30. The pulper of claim 28, wherein said drum has a longitudinal axis which is oriented one of horizontal, vertical and at an angle of between 0 and 45° relative to the horizontal.

31. The pulper of claim 19, wherein said at least one water inlet comprises two water inlets.

32. The pulper of claim 19, wherein said at least one outlet comprises one outlet.

33. A method of pulping an input source of fiber, comprising the steps of:

transporting the source of fiber to a fiber inlet of a housing, said housing having an inner chamber and a plurality of stationary pulping foils extending into said inner chamber;

injecting water into at least one water inlet of said housing;

providing a shaft assembly extending through said inner chamber, said shaft assembly including a shaft, an auger positioned around said shaft and relative to said fiber inlet, and a plurality of movable pulping foils carried by and extending from said shaft;

rotating said shaft assembly within said housing;

providing a valve positioned in association with an outlet of said housing, said valve being a conical shaped valve positioned around said shaft and selectively movable in directions along said shaft; and selectively moving said valve to open and close said outlet.

34. The method of claim 33, wherein said selectively moving step comprises selectively moving said valve to a position between a full close and a full open position.

35. The method of claim 33, wherein said transporting step comprises transporting the input source of fiber to said fiber inlet at a consistency of between 80 and 100%.

36. The method of claim 33, wherein said rotating step is carried out with an input energy of between 0.5 and 5 kilowatt*hour/metric ton.

37. The method of claim 36, wherein said rotating step is carried out with an input energy of between 0.5 and 1 kilowatt*hour/metric ton.

* * * * *